United States Patent [19]

Evans

[11] 4,015,527

[45] Apr. 5, 1977

[54] CASELESS AMMUNITION ROUND WITH SPIN STABILIZED METAL FLECHETTE AND DISINTEGRATING SABOT

[75] Inventor: Harold O. Evans, Fort Walton Beach, Fla.

[73] Assignee: The United States of America as represented by the Secretary of the Air Force, Washington, D.C.

[22] Filed: Mar. 10, 1976

[21] Appl. No.: 665,597

[52] U.S. Cl. ..... 102/38; 102/52; 102/93; 102/DIG. 1; 102/DIG. 7

[51] Int. Cl.[2] ..... F42B 5/02

[58] Field of Search ..... 102/38, 93, 52, DIG. 1, 102/DIG. 7

[56] References Cited

UNITED STATES PATENTS

| | | | |
|---|---|---|---|
| 3,262,391 | 7/1966 | Shober | 102/93 |
| 3,427,648 | 2/1969 | Manning et al. | 102/93 |
| 3,482,516 | 12/1969 | Farmer et al. | 102/38 |
| 3,585,934 | 6/1971 | Mueller et al. | 102/93 |
| 3,662,686 | 5/1972 | Baldini | 102/DIG. 7 |
| 3,688,697 | 9/1972 | Paul et al. | 102/DIG. 1 |
| 3,802,345 | 4/1974 | La Costa | 102/93 |
| 3,894,492 | 7/1975 | Barr et al. | 102/93 |
| 3,897,729 | 8/1975 | Schuneker | 102/38 |

*Primary Examiner*—Harold Tudor
*Attorney, Agent, or Firm*—Joseph E. Rusz; Arsen Tashjian

[57] ABSTRACT

A caseless round adapted for use as a high velocity armor piercing round which, in turn, is ideally suited for use by aircraft in air-to-air and air-to-ground modes. The preferred embodiment includes: a hollow, completely combustible, cylindrical-shaped casing with the aft closed and having an aperture therein; an aft grain charge and a fore grain charge, both hollow, cylindrical-shaped and open-ended, with the grain charges wholly within the casing and abutting each other and the internal surface of the casing; a primer charge wholly within the hollow aft grain charge at the aperture of the closed end of the casing; a booster charge also disposed wholly within the hollow aft grain charge, and abutting with the primer; a metal, high-density flechette, with a suitably shaped tip at the forward end and a plurality of spin-stabilizing fins at the aft end, centrally located wholly within the hollow fore grain charge; an open-ended sabot made of a plurality of identical glass reinforced polyester resin sections surrounding the flechette and having an air-catching fore end; a first seal of nylon, with an integral rotating band ring, fitted over the sabot; a nylon fore boot seal fitted over the aft open end of the sabot, and interposed between the first seal and the sabot; a nylon aft boot seal made of a plurality of identical sections forming a cavity in which the fins of the flechette are loosely fitted, and having a forwardly disposed air-catching groove. Among the advantages of the use of this round is the fact that it is significantly lighter than prior art rounds; results in shorter flight times to the target; and, thereby substantially increases hit probability.

9 Claims, 1 Drawing Figure

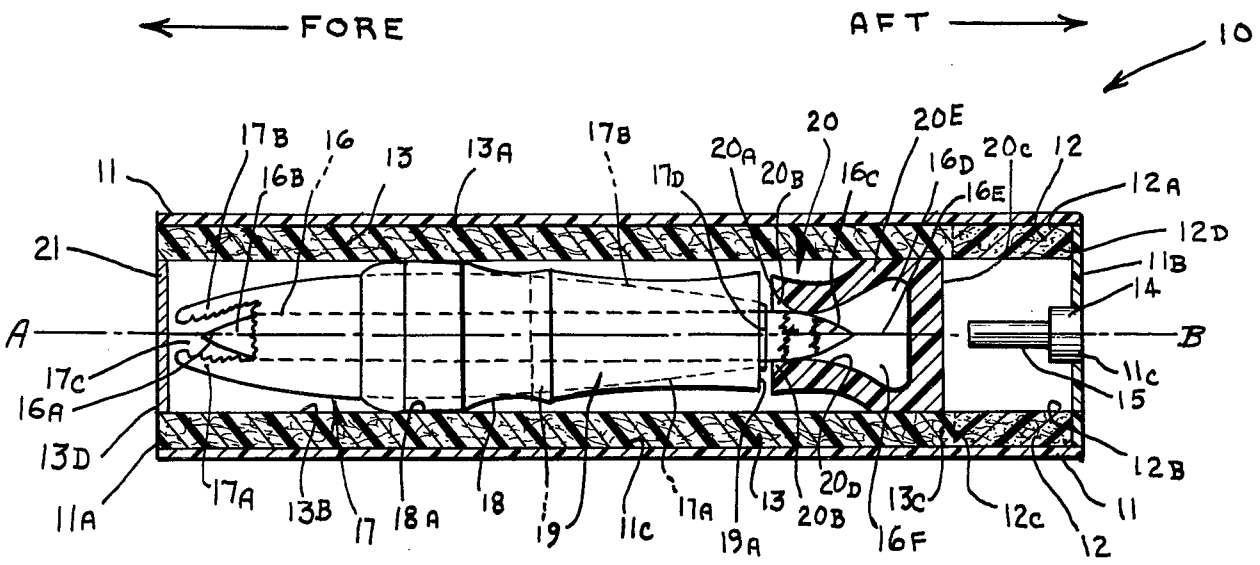
10
AFT
FORE
A
B
11
11A
11B
11C
12
12A
12B
12C
12D
13
13A
13B
13C
13D
13E
14
15
16
16A
16B
16C
16D
16E
16F
17
17A
17B
17C
17D
18
18A
19
19A
20
20A
20B
20C
20D
20E
21

CASELESS AMMUNITION ROUND WITH SPIN STABILIZED METAL FLECHETTE AND DISINTEGRATING SABOT

STATEMENT OF GOVERNMENT INTEREST

The invention described herein may be manufactured and used by or for the Government for governmental purposes, without the payment of any royalty thereon.

BACKGROUND OF THE INVENTION

This invention relates to caseless ammunition and, more particularly, to a round of that type of ammunition having a spin stabilized metal flechette and a disintegrating sabot.

It is well known in the art that the use of caseless ammunition is advantageous in that it substantially increases the firepower deliverable by, and greatly improves the overall performance of, high speed firearms, especially of the automatic type. For example, the need for extracting and ejecting spent cartridge cases is eliminated, with the result that higher (i.e., faster) firing rates are attainable. Additionally, caseless type ammunition inherently has the advantages of light weight and ease of transport. Further, and of equal importance, the ever present problem in using cartridge type ammunition, to wit: disposing of spent cartridges, is eliminated.

Despite the rapid strides in the caseless ammunition art, there has been (and there continues to be) a pressing need for a high muzzle velocity caseless round of ammunition of the armor piercing type for use by and with aircraft, in air-to-air and air-to-ground modes, in the interest of national defense.

I have invented such a round; and, thereby, have significantly advanced the state-of-the-art.

SUMMARY OF THE INVENTION

This invention pertains to a novel caseless round of ammunition which has a spin stabilized metal flechette and a disintegrating sabot, which said round is adapted for use as a high velocity armor piercing round which, in turn, is ideally suited for use by aircraft in air-to-air and air-to-ground modes.

Therefore, the principal object of this invention is to teach the structure of this novel round of caseless ammunition.

This principal object, as well as other equally important and related objects, of my inventive round of caseless ammunition will become readily apparent after a consideration of the description of the inventive round, coupled with reference to the drawing.

DESCRIPTION OF THE DRAWING

The drawing is a side elevation view, in simplified form and partially in cross section and also partially fragmented, of a preferred embodiment of my inventive round of caseless ammunition.

DESCRIPTION OF THE PREFERRED EMBODIMENT

With reference to the drawing, therein is shown the structure of a preferred embodiment 10 of my inventive round of caseless ammunition, as adapted for use from a moving airborne aircraft as an armor piercing round to be shot, or otherwise launched, at a hostile airborne target (i.e., air-to-air) or at a hostile ground target (i.e., air-to-ground).

For orientation purposes, the drawing shows directional arrows respectively legended "Fore" and "Aft" which, of course, are to be understood as meaning forward and rearward, respectively.

As shown in the drawing, the preferred embodiment 10 includes: a hollow, outer, combustible case 11 or casing in the configuration of a cylinder, with its aft end 11B closed and having an aperture 11C therein; an aft grain charge 12 shaped in the form of a hollow, open-ended cylinder, disposed wholly within the outer case 11; another grain charge 13 (hereinafter referred to as the "fore grain charge") shaped in the form of a hollow, open-ended cylinder, disposed forward of the aft grain charge 12, and also disposed wholly within the outer case 11; a primer charge 14 disposed within the outer case 11 at the aft end 11B thereof, and positioned at the aperture 11C and within the hollow aft grain charge 12; a booster charge 15 disposed within the outer case 11 at the aft end 11B thereof, and positioned in communication with, and forwardly of, the primer charge 14 and within the hollow aft grain charge 12; a flechette 16, having a longitudinal axis A-B, with a plurality of fins (such as representative ones 16D, 16E and 16F) at the aft end 16C of the flechette 16; a sabot 17 comprising a plurality of identical constituent portions or sections, such as 17A and 17B, surrounding the flechette 16 in a snug fit; a first seal 18 fitted over the multi-piece sabot 17; a fore boot seal 19 fitted over the aft end 17D of the sabot 17, and interposed between, and press fit between, the first seal 18 and the sabot 17; an aft boot seal 20 having an open fore end 20A with a forwardly disposed air-catching circumferential groove 20B thereat, a closed aft end 20C, and a cavity 20D in communication with the open fore end 20A, and with the aft boot seal 20 comprising a plurality of portions (such as representative one 20E) that are loosely fitted around the plurality of flechette fins, such as representative ones 16D, 16E, and 16F; and, a second seal 21 disposed at the open fore end 13D of the fore grain charge 13.

Still with reference to the drawing, it is to be noted: that outer casing 11 also has a forwardly disposed end 11B (hereinafter referred to as the "fore end") that is open, and an internal surface 11C; that aft grain charge 12 has an outer surface 12A, an inner surface 12B, a fore surface 12C, and an aft surface 12D, and that the outer surface 12A of the charge 12 abuts with the internal surface 11C of casing 11, and also that the aft surface 12D of the charge 12 abuts with the closed aft end 11B of casing 11; that fore grain charge 13 has an open fore end 13D, an outer surface 13A, an inner surface 13B, and an aft surface 13C, with the outer surface 13A abutting with the internal surface 11C of casing 11, and with 16C aft surface 13B abutting with the fore surface 12C of the aft grain charge 12; that flechette 16 is centrally located wholly within the hollow fore grain charge 13, and that the flechette 16 has a tip 16A at the fore end 16B which may be varied to suit the circumstance, but is preferably pointed; that sabot 17 has an air-catching open fore and 17C (which is fragmented for illustrative purposes only to show that the flechette front tip 16A is positioned at the open fore end 17C) and an open aft end 17D through which the aft end 16 of flechette 16 protrudes; that first seal 18 is disposed wholly within hollow fore grain charge 13, and has a rotating band ring 18A external of, abutting with, and integrated with the first seal 18, with the rotating band ring 18A abutting with the inner surface 13B of the fore grain charge; that the fore boot seal 19 has an aft end bearing surface 19A; and, that the aft boot seal portions or sections, such as representative one 20E, abut the inner surface 13B of the fore grain charge 13.

It is also to be noted: that our case 11 is combustible and completely consumable thereby, and, in that regard, is preferably made of nitrocellulose in which preferably are embedded acrylic fibers (although embedded kraft fibers can be used); that fore grain charge 13 and aft grain charge 12 are preferably made from a granular propellant (or propellants); that flechette 16 is of high density material, preferably steel, (although tungsten carbide or steel and zirconium can be used), and also preferably has a length-to-thickness (i.e., width or diameter) ratio of approximately 16 to 1; that, as a matter of preference, the sabot 17 is made of 4 identical constituent portions or sections; that the first seal 18 preferably is made of a polyamide resin, such as nylon, as is the integral rotating band ring 18A thereof; that the fore boot seal 19 preferably is of 1 piece and also is preferably made of a polyamide resin, such as nylon; and, that the aft boot seal 20 preferably is made either of 4 or of 2 identical portions or sections, such as 20E, which in turn are preferably made of a polyamide resin, such as nylon, and the cavity 20D is of such dimensions that the flechette fins, such as 16D and 16E, do not bottom out.

MANNER OF OPERATION OF THE PREFERRED EMBODIMENT

Assuming that the preferred embodiment 10 is in the chamber of a gun having a barrel with a rifled bore and a muzzle, then after the gun is fired, the primer 14 is initiated and explodes, setting off the booster 15. That 15, in turn, ignites the aft grain charge 12 and simultaneously begins to force the flechette-sabot-first seal-fore boot seal-aft boot seal combination (hereinafter referred to as the "Flechette Combination") through the second seal 21 and forward into the bore of the barrel. Gases and flame, behind the flechette combination ignites the foregrain charge 13. Both grain charges 12 and 13 burn, resulting in the formation of propellant gases which effect the forward movement, or propulsion of the flechette combination through the rifled bore of the gun barrel; and out of the muzzle of the barrel.

Simultaneous with the forward propulsion of the flechette combination, the burning of the grain charge 12 and 13 also results in the burning, and in the complete consumption thereby, of the outer case 11, which had remained in the gun chamber after separation of the flechette combination.

During forward travel of the flechette combination while in the barrel, the rotating band ring 18A of first seal 18 is engraved by rifling in the gun barrel; and, it 18A forms a forward propellant gas seal, while it 18A imparts a spin to the flechette combination. Simultaneously, the fore boot seal 19 (with the aft end bearing surface 19A) acts as a propellant gas seal for the flechette combination, and the aft boot seal 20 acts as a seal plate pusher.

The air catching circumferential groove 20B of aft boot seal 20 reduces balloting of the flechette combination within the barrel; reduces initial yaw after muzzle exit of the flechette combination; and, causes the separation of the aft boot seal 20 from the flechette 16 and from the flechette fins (such as representative ones 16D, 16E and 16F) after the exit of the flechette combination from the barrel.

Then, the air-catching open fore end 17C of the sabot 17 establishes an overpressure which causes the abot 17 to rupture the first seal 18, resulting in the separation of the first seal 18 and of the sabot 17 from the flechette 16. This separation is assisted by the centrifugal forces imparted by the spin caused by the rifling. The flechette 16 is then on the way to the target.

CONCLUSION

It is abundantly clear from all of the foregoing and from the drawing, that the stated and desired principal object of my invention has been attained. In addition, related desirable objects have been achieved, e.g., the lighter mass of the flechette combination (approximately 2000 grains), as compared to the prior art projectile (approximately 3000 grains), results in a shorter flight time to the target and, there, increase in hit probability (estimated at a 15 to 20 percent increase).

It is to be noted that, although there have been described and shown the fundamental and unique features of my inventive caseless ammunition round as applied to a particular preferred embodiment, various other embodiments, adaptations, substitutions, additions, omissions, and the like will occur to, and can be made by, those of ordinary skill in the art. For example: (1) Fore grain charge 13 and aft grain charge 12 can be cast as one piece; and, (2) The first seal 18 can be structured with longitudinally disposed stress points or lines to easily and quickly cause rupture of the first seal 18 (at these stress points and lines) by sabot 17 when the flechette combination exits from the muzzle of the barrel.

What is claimed is:

1. A caseless round, comprising:

a. a cylindrical-configurated hollow outer case having a fore end, an aft end and an internal surface, with said fore end open and said aft end closed, and with said closed aft end having an aperture therein;

b. an aft grain charge shaped in the form of a hollow, open-ended cylinder and having an outer surface, an inner surface, an aft surface and a fore surface, with said aft grain charge disposed wholly within said hollow outer case, and with said outer surface of said aft grain charge abutting with said internal surface of said outer case, and also with said art surface of said aft grain charge abutting with said closed aft end of said outer case;

c. a fore grain charge shaped in the form of a hollow, open-ended cylinder and having an outer surface and an aft surface, with said fore grain charge disposed within said hollow outer case, and with said outer surface of said fore grain charge abutting with said internal surface of said outer case, and also with said aft surface of said fore grain charge abutting with said fore surface of said aft grain charge;

d. a primer charge disposed within said hollow outer case at the aft end thereof, and with said primer charge positioned at said aperture of said outer case aft end and within said hollow, open-ended aft grain charge;

e. a booster charge disposed within said hollow outer case at the aft end thereof, and with said booster charge positioned in communication with, and fore of, said primer charge and within said hollow, open-ended aft grain charge;

f. a flechette of high density material, with said flechette having a longitudinal axis, a fore end with a suitably shaped tip thereat, and an aft end with a plurality of fins thereat, and with said flechette centrally located wholly with said hollow, open-ended fore grain charge;

g. a sabot, with an open fore end and an open aft end, comprising a plurality of identical constituent portions disposed wholly within said hollow open-ended fore grain charge, and surrounding said flechette in a snug fit, with said open fore end of said flechette shaped to catch air and positioned at said open fore end of said sabot, and with said aft end of said flechette protruding from said open aft end of said sabot;

h. a first seal fitted over said sabot and disposed wholly within said hollow open-ended fore grain charge, with said first seal having a rotating band ring external of, abutting with, and integrated with said first seal, and with said rotating band ring abutting with said inner surface of said fore grain charge;

i. a fore boot seal fitted over said open aft end of said sabot, and interposed between, and press fit between, said first seal and said sabot;

j. an aft boot seal having an open fore end with a forwardly disposed air-catching circumferential groove thereat, a closed aft end, and a cavity in communication with said open fore end, with said aft boot seal comprising a plurality of portions loosely fitted around said plurality of fins of said flechette, and with said fins wholly within said aft boot seal cavity, and also with said aft boot seal portions abutting said inner surface of said fore grain charge, thereby releasably uniting said aft boot seal portions;

k. and, a second seal disposed at the open fore end of said fore grain charge, thereby closing said end.

2. A caseless round, as set forth in claim 1, wherein said outer case is made of nitrocellulose in which are embedded acrylic fibers.

3. A caseless round, as set forth in claim 1, wherein said aft grain charge and said fore grain charge are integrated to form a single, hollow open-ended cylinder made from a granular propellant.

4. A caseless round, as set forth in claim 1, wherein said flechette is made of metal.

5. A caseless round, as set forth in claim 1, wherein said sabot comprises four identical constituent portions made of glass reinforced polyester resin.

6. A caseless round, as set forth in claim 1, wherein said first seal is made of a polyamide resin.

7. A caseless round, as set forth in claim 1, wherein said fore boot seal is made of a polymide resin.

8. A caseless round, as set forth in claim 1, wherein said aft boot seal comprises two identical portions made of a polyamide resin.

9. A caseless round, as set forth in claim 1, wherein said aft boot seal comprises four identical portions made of a polyamide resin.

* * * * *